US006710235B2

(12) United States Patent
Hirayama

(10) Patent No.: US 6,710,235 B2
(45) Date of Patent: Mar. 23, 2004

(54) ELECTRIC GUITAR WITH TREMOLO UNIT

(75) Inventor: Shinjiro Hirayama, Aichi (JP)

(73) Assignee: Hoshino Gakki Co. Ltd. (JP)

( * ) Notice: Subject to any disclaimer, the term of this patent is extended or adjusted under 35 U.S.C. 154(b) by 0 days.

(21) Appl. No.: 10/171,493

(22) Filed: Jun. 13, 2002

(65) Prior Publication Data

US 2003/0066409 A1 Apr. 10, 2003

(30) Foreign Application Priority Data

Oct. 5, 2001 (JP) ..... 2001-310745

(51) Int. Cl.[7] ..... G10D 3/00

(52) U.S. Cl. ..... 84/313; 84/312 R; 84/298; 84/299; 84/307

(58) Field of Search ..... 84/313, 312 R, 84/298, 299, 307

(56) References Cited

U.S. PATENT DOCUMENTS 4,171,661 A 10/1979 Rose ..... 84/313
4,549,461 A 10/1985 Rose ..... 84/313
4,967,631 A 11/1990 Rose ..... 84/313
5,083,492 A * 1/1992 Gorr ..... 84/313
5,986,191 A * 11/1999 McCabe ..... 84/313

* cited by examiner

*Primary Examiner*—Shih-Yung Hsieh
(74) *Attorney, Agent, or Firm*—Ostrolenk, Faber, Gerb & Soffen, LLP

(57) ABSTRACT

An electric guitar has strings. Each string has a first contact point defined on a neck and a second contact point defined on a base plate attached to a body. The guitar includes a hinge mechanism for supporting the base plate such that the base plate pivots relative to the body. The hinge mechanism includes a pair of bores, each of which is formed at a side of the base plate. A bearing device is located in each bore. A pair of support pins protrudes from the body. Each support pin corresponds to one of the bearing devices and is located closer to the neck than the corresponding bearing device. A bracket is coupled to each support pin. A bracket pin is coupled to each bracket and fits into the corresponding bearing device. The axial midpoint of each bearing device and the center of the corresponding support pin are located on a line that is substantially parallel to the strings.

20 Claims, 6 Drawing Sheets

ELECTRIC GUITAR WITH TREMOLO UNIT

BACKGROUND OF THE INVENTION

The present invention relates to an electric guitar with a tremolo unit.

An electric guitar that has a tremolo unit prevents the electric guitar from being detuned by changes in the tension (pitch) of strings while the guitar is being played using the tremolo unit. U.S. Pat. No. 4,171,661 discloses an electric guitar that has a tremolo unit. According to the guitar of the publication, each string is locked by a bolt and a presser member at a saddle of the tremolo unit. A fixing member is also arranged on a nut, which is located in the vicinity of the head, to fix the strings. This structure prevents the guitar to be detuned even if the tremolo unit is used.

FIG. 8 illustrates another type of tremolo unit. This tremolo unit has a base plate 23 and a hinge mechanism for connecting the base plate 23 to a guitar body. A pair of pin supports 61, 61 is integrally formed with the base plate 23 at the sides of the base plate 23. A bore 61*a* is formed in each pin support 61. A coupling pin 62 is connected to each pin support 61 by press fitting the proximal end of the pin 62 into the bore 61*a*. A pair of brackets 64, 64 is coupled to the body with support pins 63, 63. Each bracket 64 can pivot about the corresponding support pin 63. A bearing device comprising a single bearing 65 fits in each bracket 64. Each coupling pin 62 fits into the central bore of the corresponding bearing 65.

Since the coupling pins 62 receive relatively great tension of the strings, the bores 61*a* need to be sufficiently deep to bear the tension. Also, since the bearings 65, 65 receive the tension of the strings, the bearings 65 need to be sufficiently long to bear the tension. The distance D1 between the centers O1, O1 of the bores 61*a*, 61*a* and the distance between the center O1 of each bore 61*a* and the axial midpoint O2 of the corresponding bearing 65 are determined to ensure sufficient depth of the bores 61*a* and sufficient length of bearings 65

The distance D3 between the axial midpoint O2 of each bearing 65 (the corresponding midpoint O3) and the outer edge of the corresponding bracket 64 is determined such that the midpoint O3 of each support pin 63 is included in a line that contains the axial midpoint O2 of the corresponding bearing 65 and is parallel to the strings. Accordingly, the tension of the strings evenly acts on the bearings 65, 65. In this structure, the distance between the outer edges of the brackets 64, 64 is represented by a formula $D1+2\times D2+2\times D3$. The brackets 64 thus require a relatively large lateral space. If widely separated, the brackets 64 impair the appearance of the guitar.

SUMMARY OF THE INVENTION

Accordingly, it is an objective of the present invention to provide an electric guitar with a tremolo unit that minimizes the space required for a hinge mechanism supporting the base plate.

To achieve the foregoing and other objectives and in accordance with the purpose of the present invention, an electric guitar having a plurality of strings is provided. Each string has a first contact point defined on a neck and a second contact point defined on a base plate attached to a body. The guitar includes a hinge mechanism for supporting the base plate such that the base plate pivots relative to the body. The hinge mechanism includes a pair of bores, a pair of bearing devices, a pair of support pins, a pair of brackets, and a pair of bracket pins. Each bore is formed at a side of the base plate. Each bearing device is located in one of the bores. The support pins protrude from the body. Each support pin corresponds to one of the bearing devices and is located closer to the neck than the corresponding bearing device. Each bracket is coupled to one of the support pins. Each bracket pin is coupled to one of the brackets and fits into the corresponding bearing device. The axial midpoint of each bearing device and the center of the corresponding support pin are located on a line that is substantially parallel to the strings.

Other aspects and advantages of the invention will become apparent from the following description, taken in conjunction with the accompanying drawings, illustrating by way of example the principles of the invention.

BRIEF DESCRIPTION OF DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An electric guitar 11 with a tremolo unit 21 according to one embodiment of the present invention will now be described with reference to FIGS. 1 to 7.

Figure 7:
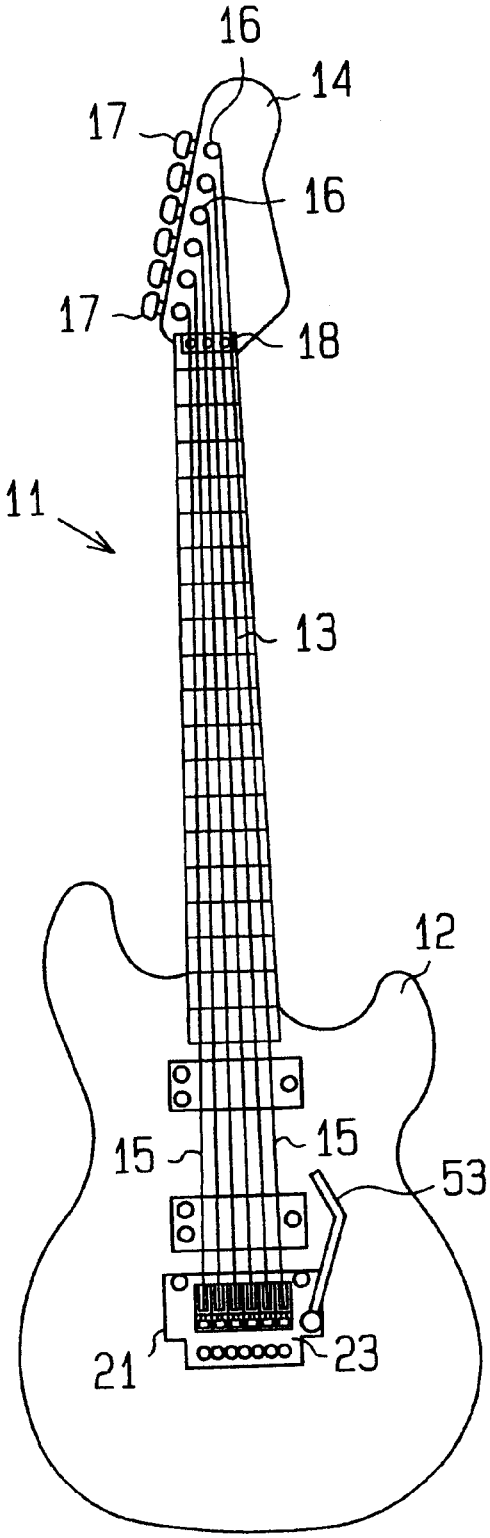
FIG. 7 is a front view illustrating an electric guitar.

FIG. 7 shows the entire electric guitar 11.

The electric guitar 11 includes a solid body 12 and a neck 13, which extends from the body 12. A head 14 is located at the distal end of the neck 13. Six tuning posts 16 are arranged on the head 14 and can be rotated to wind up strings 15. A gear mechanism (not shown) is arranged on the backside of each tuning post 16. Tuning pegs 17, each of which is provided for one of the tuning posts 16, are located on the head 14. Each tuning peg 17 rotates the corresponding tuning post 16 by the gear mechanism. That is, each set of the tuning post 16, the gear mechanism, and the tuning peg 17 tunes the corresponding string 15. A nut 18 is located at the distal end of the neck 13 and the strings 15 contact the nut 18. The contact points between the nut 18 and the strings 15 will be referred to as first contact points. The strings 15 are pressed against the nut 18 by a pressing member and are tightened to the nut 18 with bolts.

The tremolo unit 21 is located substantially at the center of the body 12. The six strings 15 contact the nut 18 and the tremolo unit 21. The strings 15 are tightly stretched at a predetermined tension and substantially parallel to one another. The body 12 has pick-ups, which detect vibration of the strings 15 and convert the vibration into electric signals.

The electric signals generated by the pick-ups are transmitted to an amplifier via a cable (not shown) to be amplified.

Figure 6:
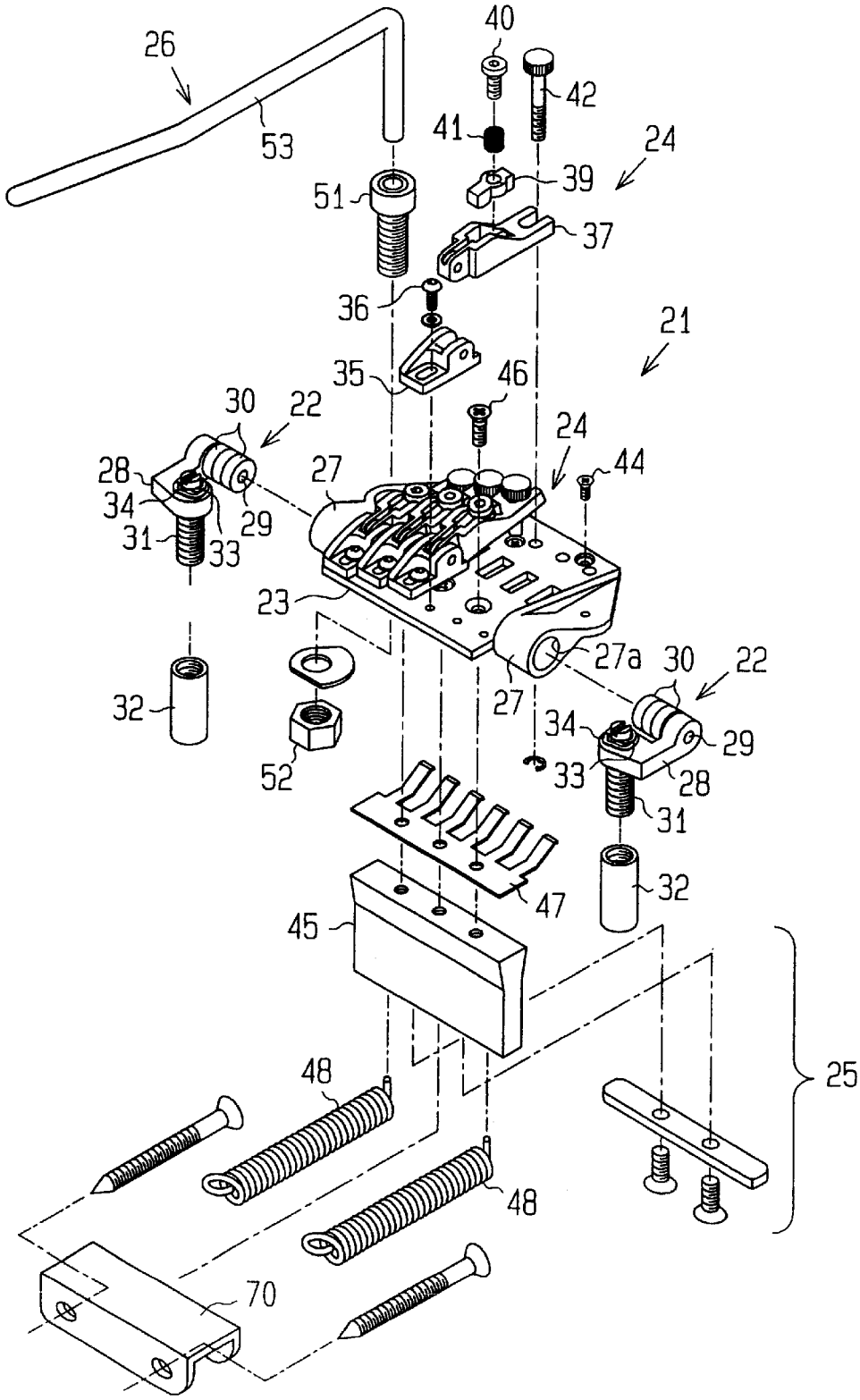
FIG. 6 is an exploded perspective view illustrating the tremolo unit shown in FIG. 1.

As shown in FIG. 6, the tremolo unit 21 includes a base plate 23 and bridge saddles 24. The base plate 23 is pivotally arranged on the body 12 by a hinge mechanism 22. The bridge saddles 24 are arranged on the upper surface of the base plate 23 and support the strings 15. The tremolo unit 21 includes a tension applying mechanism 25 and a tremolo manipulation mechanism 26. The tension applying mechanism 25 urges the base plate 23 such that the base plate 23 is pivoted in a direction to apply tension to the strings 15. The tremolo manipulation mechanism 26 is located on the base plate 23 and is used to pivot the base plate 23 about the hinge mechanism 22.

The hinge mechanism 22 includes a pair of brackets 28 and two bearing devices, each bearing device comprising two bearings 30. Each bracket 28 is secured to the base plate 23 by a support pin, which is a stud bolt 31 in this embodiment. Each bearing device is coupled to the distal end of the corresponding bracket 28 by a bracket pin 29. A pair of pin supports 27 is formed integrally with the base plate 23 on both left and right sides. Each pin support 27 includes a bore 27*a*. The bearings 30 of each bearing device are fitted into the corresponding bore 27*a*.

Figure 5:
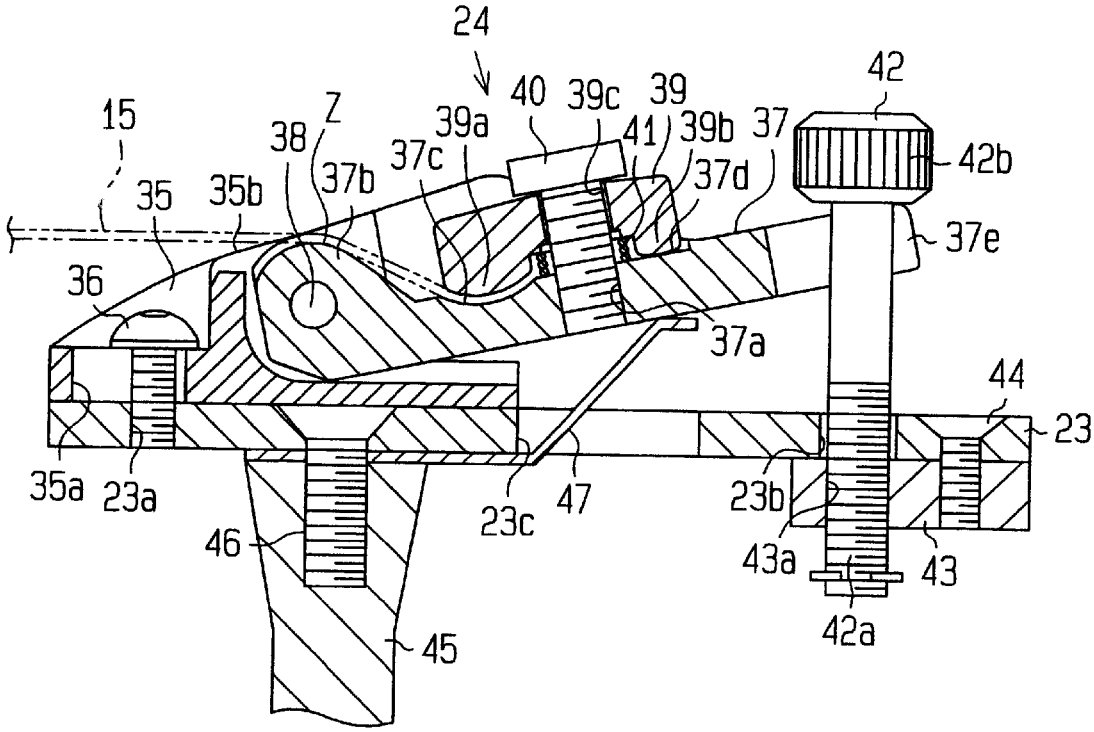
FIG. 5 is an enlarged cross-sectional view illustrating the bridge saddle of the tremolo unit shown in FIG. 1.

FIG. 5 illustrates one of the bridge saddles 24. Since the bridge saddles 24 are identical, the structure of one of the bridge saddles 24 will be described with reference to FIGS. 5 and 6. A saddle holder 35 is mounted on the bridge saddle 24. As shown in FIG. 5, the saddle holder 35 has a slot 35*a* at its distal end. As shown in FIGS. 5 and 6, threaded holes 23*a* are formed in the base plate 23. A bolt 36 is inserted downward in the slot 35*a*. The bolt 36 is then threaded into the corresponding threaded hole 23*a* so that the saddle holder 35 is secured to the upper surface of the base plate 23. A saddle 37 is mounted on the saddle holder 35. A pin support 35*b* is formed integrally with the saddle holder 35. The distal end of the saddle 37 is coupled to the pin support 35*b* with a pin 38 so that the saddle 37 can pivot. A clamp pad 39 is located on the upper surface of the saddle 37. The clamp pad 39 is securely tightened to the saddle 37 with a string fixing bolt 40. A threaded hole 37*a* is formed in the saddle 37. The string fixing bolt 40, which is inserted through the clamp pad 39, is threaded into the threaded hole 37*a*. A string receiver 37*b*, which is formed at an end of the saddle 37, contacts the corresponding string 15 at a contact point Z.

The clamp pad 39 includes a retainer 39*a* and a fulcrum 39*b*. The retainer 39*a* retains the corresponding string 15 in cooperation with a receiving surface 37*c* of the saddle 37. The fulcrum 39*b* contacts the saddle 37. A through hole 39*c* is formed in the clamp pad 39. The through hole 39*c* loosely receives the string fixing bolt 40. The end of the corresponding string 15 is held between the retainer 39*a* of the clamp pad 39 and the receiving surface 37*c* of the saddle 37.

An elastic member, which is a coil spring 41 in this embodiment, is located between the clamp pad 39 and the saddle 37 to urge the clamp pad 39 away from the saddle 37. A slot 37*e* is formed at the distal end of the saddle 37. A threaded portion 42*a* of a fine-tuning bolt 42 is inserted downward through the slot 37*e* of the saddle 37. The fine-tuning bolts 42 and the saddles 37 form a fine-tuning device. A head 42*b* of the fine-tuning bolt 42 is engaged with the top edge of the slot 37*e*. A mounting plate 43 is attached to the lower surface at the rear end of the base plate 23 with screws 44. Threaded holes 43*a* are formed in the mounting plate 43. The threaded portion 42*a* of the fine-tuning bolt 42 is threaded into the corresponding threaded hole 43*a*. Guide holes 23*b* are formed in the base plate 23. The fine-tuning bolt 42 extends through one of the guide holes 23*b*.

As shown in FIGS. 5 and 6, a tremolo block 45 is secured to the lower surface of the base plate 23 with bolts 46. A leaf spring member 47, which has leaf springs, is held between the lower surface of the base plate 23 and the top surface of the tremolo block 45. As shown in FIG. 5, the distal end of each leaf spring of the leaf spring member 47 is guided through the corresponding through hole 23*c* and pressed against the lower surface of the corresponding saddle 37. Therefore, the side edge of the slot 37*e* is pressed against the head 42*b* of the fine-tuning bolt 42. The tension applying mechanism 25 includes a pair of springs 48. One end of each spring 48 is engaged with the lower, or distal, end of the tremolo block 45. The other end of each spring 48 is engaged with a bracket 70, which is fixed to the body 12 at a predetermined position. The springs 48 urge the tremolo block 45 in the clockwise direction as viewed in FIGS. 2 and 5. Accordingly, the base plate 23 is urged clockwise about the pins 29 and causes the bridge saddles 24 to apply tension to the strings 15.

As shown in FIG. 6, the tremolo manipulation mechanism 26 includes a hollow bolt 51, a nut 52, and a bent tremolo bar 53. The hollow bolt 51 is inserted downward through one side of the base plate 23. The nut 52 is tightened to the lower end of the hollow bolt 51 to secure the hollow bolt 51 to the base plate 23. The distal end of the bent portion of the tremolo bar 53 is detachably inserted into the hollow bolt 51. When the tremolo bar 53 is tilted toward or away from the body 12, the base plate 23 of the tremolo unit 21, the bridge saddles 24, and the tremolo block 45 are slightly pivoted about the pins 29 against the force of the springs 48.

The hinge mechanism 22 will now be described with reference to FIGS. 1 to 4.

Figure 4:
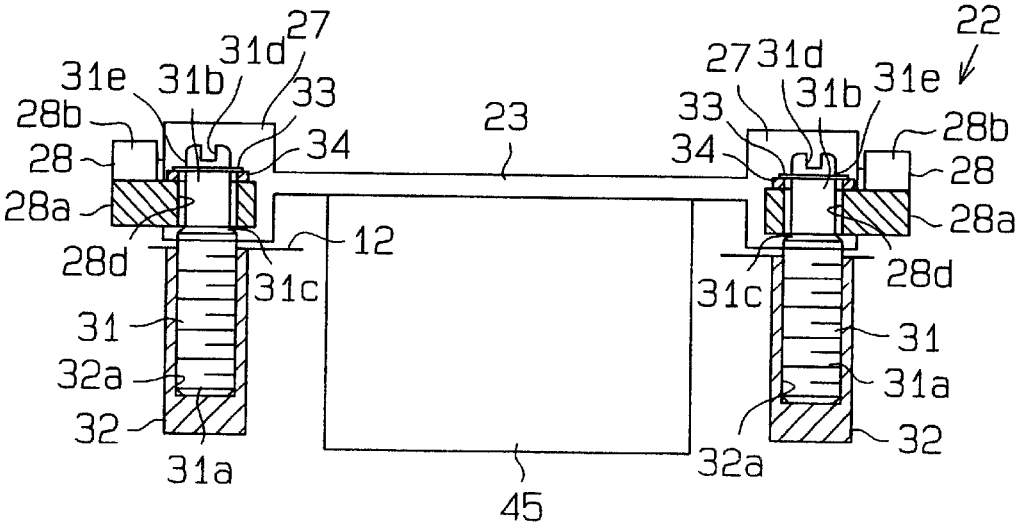
FIG. 4 is a cross-sectional view taken along line 4—4 of FIG. 1.

Nuts 32 are embedded in the body 12. Each nut 32 has a threaded hole 32*a*. As shown in FIG. 4, each stud bolt 31 has a threaded portion 31*a* and a coupling portion 31*b*. The threaded portion 31*a* is threaded into the threaded hole 32*a* of the corresponding nut 32. A seat 31*c* is defined between the threaded portion 31*a* and the coupling portion 31*b* of each stud bolt 31. The seat 31*c* has a convex support surface.

Figure 1:
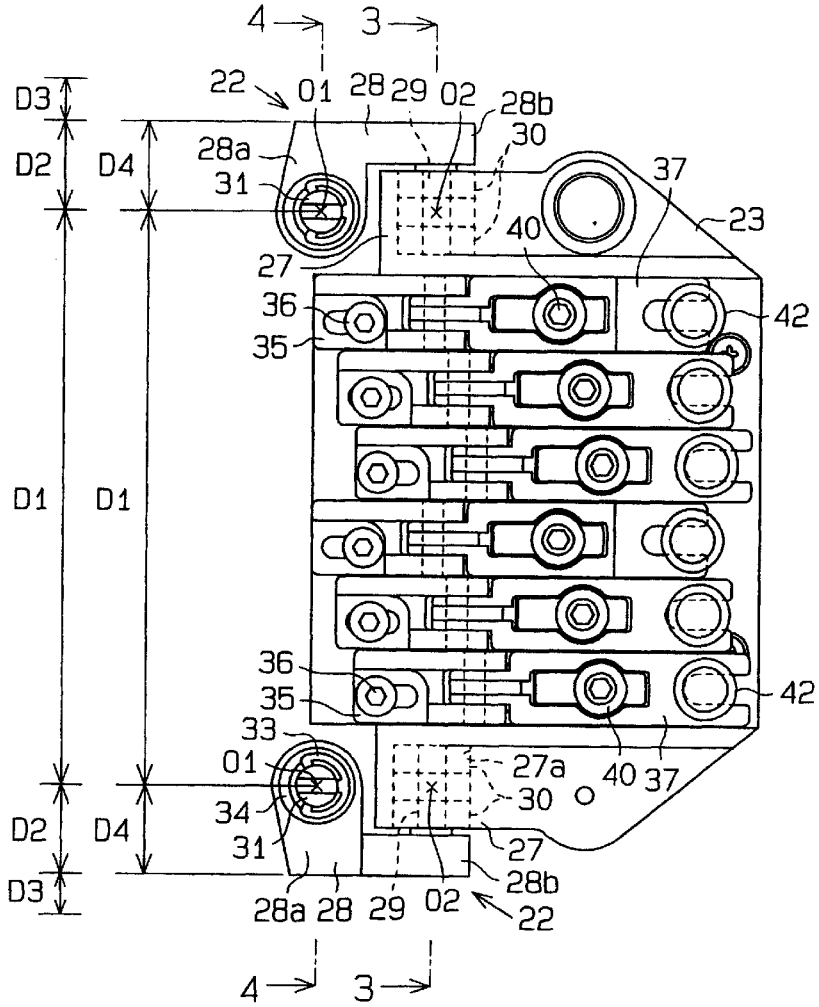
FIG. 1 is a plan view illustrating a tremolo unit of an electric guitar according to the present invention.
Figure 2:
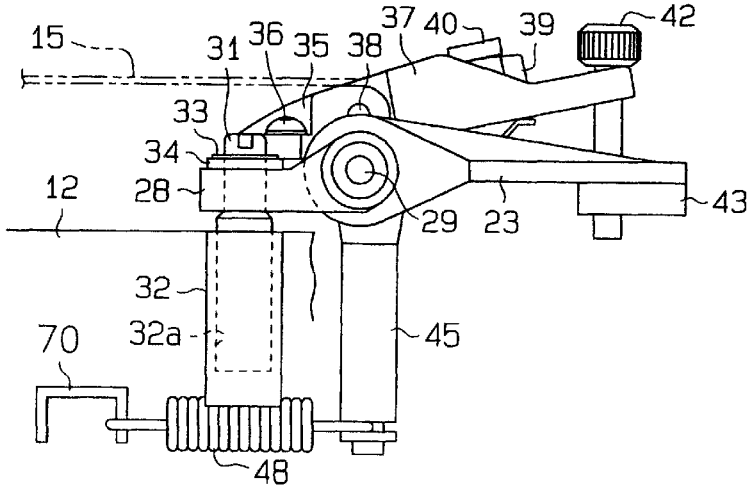
FIG. 2 is a side view of the tremolo unit shown in FIG. 1.

A slot 31*d* is formed at the distal end of the coupling portion 31*b* of each stud bolt 31. The slot 31*d* is used when the stud bolt 31 is rotated with a tool such as a screwdriver. An annular groove 31*e* is formed in the vicinity of the slot 31*d*. A fastener, which is an E-shaped snap ring 33 in this embodiment, is engaged with the annular groove 31*e*. As shown in FIG. 1, each bracket 28 is formed like an elbow and includes a proximal portion 28*a* and an arm 28*b*. An elastic ring 34 made of rubber is located between the proximal portion 28*a* of the bracket 28 and the E-shaped snap ring 33 to elastically support the bracket 28. A bore 28*c* is formed in the end of the arm 28*b*. The corresponding bracket pin 29 fits into the bore 28*c*. An elongated hole 28*d* is formed in the proximal portion 28*a*. The coupling portion 31*b* of the corresponding stud bolt 31 extends through the elongated hole 28*d*. Each elongated hole 28*d* is elongated in a direction perpendicular to the strings 15.

Figure 3:
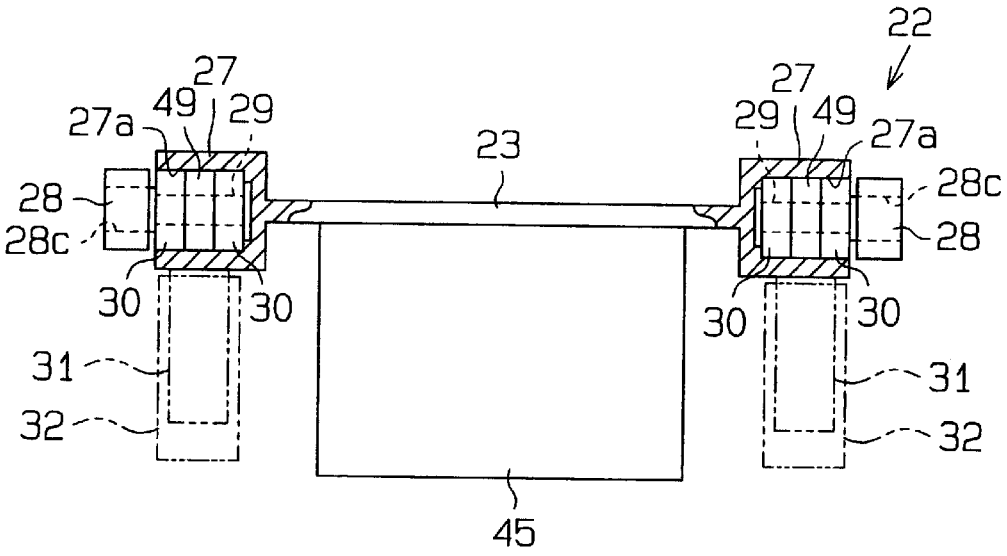
FIG. 3 is a cross-sectional view taken along line 3—3 of FIG. 1.

As shown in FIG. 3, the two bearings 30 are located in the bore 27*a* of each pin support 27. A spacer ring 49 is located between the bearings 30. The two bearings 30 and the spacer ring 49 comprise one embodiment of the bearing device.

The operation of the tremolo unit 21 will now be described.

To change the tension of each string 15 while substantially maintaining the position of the second contact point Z, the head 42*b* of the corresponding fine-tuning bolt 42 is manually rotated. The engagement between the head 42*b* and the corresponding saddle 37 pivots the saddle 37 clockwise or counterclockwise about the pin 38, which fine-tunes the tension of the string 15.

To tune the harmonics of all the strings 15 while changing the second contact points Z, the strings 15 are unlocked at the first contact points by loosening the pressing member of the nut 18. Then, the strings 15 are loosened by rotating the tuning posts 16 with the tuning pegs 17. In this state, the bolts 36 are loosened, and each saddle holder 35 is moved along the slot 35*a* to adjust the position of the saddle 37. Then, the bolts 36 are fastened to fix the saddle holders 35 to the base plate 23. Thereafter, the tuning posts 16 are rotated by the tuning pegs 17 to tune the strings 15. The strings 15 are then locked by the pressing member of the nut 18. A rough adjustment of the harmonics is thus completed.

Each string 15 is then fine-tuned by rotating the corresponding fine tuning bolt 42. After fine-tuning all the strings 15, whether the harmonics of the strings 15 are properly set is determined. If the harmonics are not properly set, the position of each saddle holder 35 is further adjusted.

The advantages of the tremolo unit 21 will now be described in connection with the structure.

Figure 8:
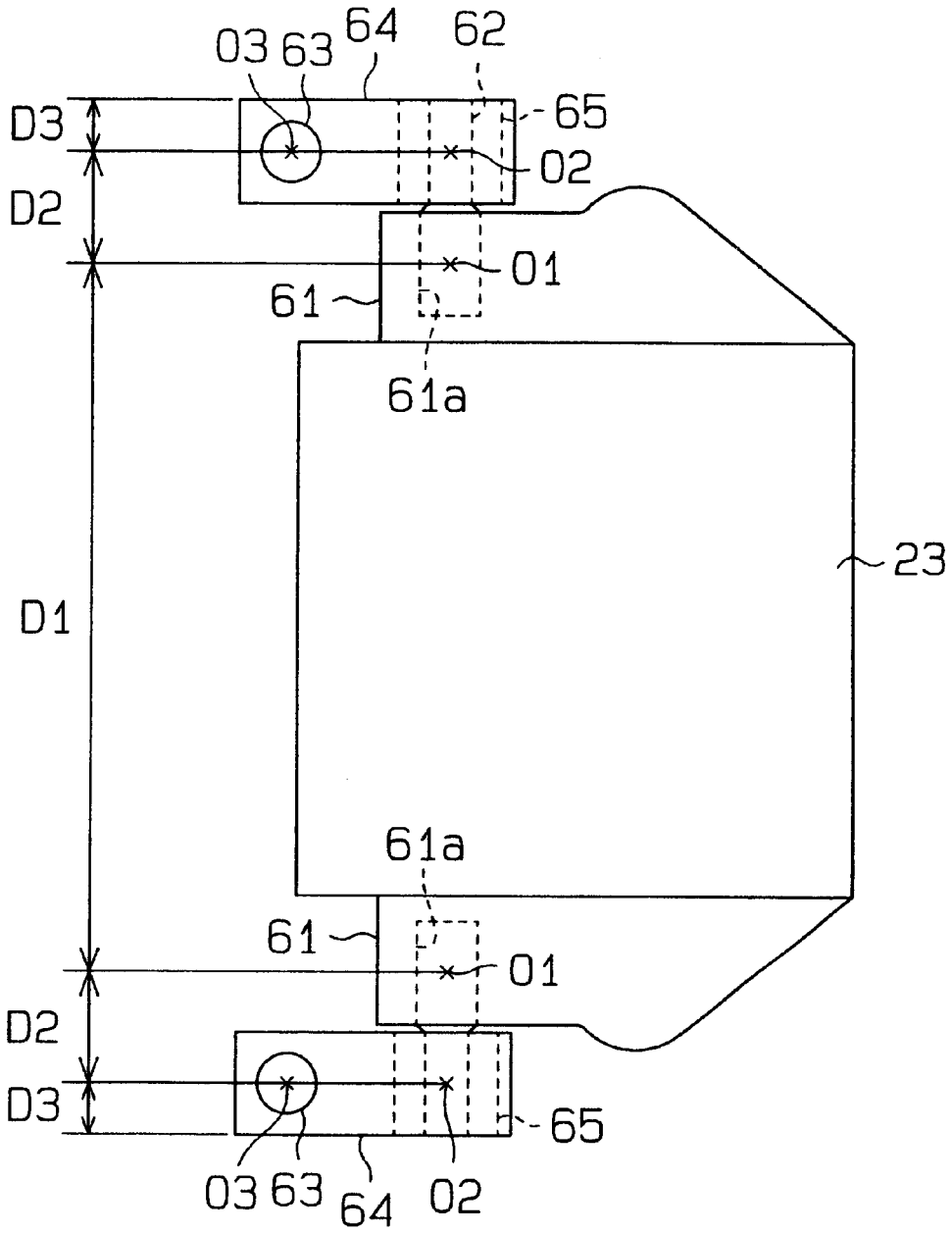
Fig.8(Prior Art)
FIG. 8 is a plan view illustrating the hinge mechanism of a prior art tremolo unit.

(1) As shown in FIG. 1, the bearings 30 are fitted into the hole 27*a* of each pin support 27, and the bracket pin 29 extending from the elbow shaped bracket 28 is inserted into the bearings 30. The stud bolts 31 are located forward of the pin supports 27 to be laterally aligned with the bearings 30. Although, the distance D1 between the centers O1, O1 of the stud bolts 31 is substantially the same as the distance D1 (see FIG. 8) of the prior art tremolo unit, the distance D4 from the center O1 to the outer edge of the arm 28*b* of the bracket 28 is relatively short. Therefore, the space required for the hinge mechanism 22 is smaller than the prior art (see the distances D1, D2, D3).

(2) As shown in FIG. 1, the center O1 of each stud bolt 31 and the axial midpoint O2 of the corresponding bearing device are located on a line that is parallel to the strings 15. Therefore, the tension of the strings 15 is applied to the center O1 of each stud bolt 31 through the base plate 23, the corresponding pin support 27, the corresponding bearing device, the corresponding bracket pin 29 and the corresponding bracket 28. Thus, bending moment does not act on the bearings 30. Therefore, the tremolo manipulation mechanism 26 is stably controlled.

(3) The elastic ring 34 is provided between the proximal portion 28*a* of each bracket 28 and the corresponding E-shaped snap ring 33. Thus, even if the sides of the base plate 23 are displaced toward or away from the body 12, the displacement is absorbed by the elastic rings 34, which stabilizes the state of the brackets 28.

(4) The elongated hole 28*d* is formed in the proximal portion 28*a* of each bracket 28, and the elongated hole 28*d* extends in a direction perpendicular to the strings 15. Each elongated hole 28*d* receives the coupling portion 31*b* of the corresponding stud bolt 31. This permits a slight displacement of the base plate 23 along a direction perpendicular to the strings 15, and the states of the brackets 28 are stably changed accordingly.

(5) The seat 31*c* on each stud bolt 31 is convex. Thus, even if the attitudes of the brackets 28 are changed, the circumference of each elongated hole 28*d* is stably supported.

(6) The number of the bearings 30, which fit into the hole 27*a* of each pin support 27, is two. The spacer ring 49 is located between each pair of the bearings 30, which increases the axial dimension of the bearing device. Thus, the pins 29 are stably supported by the pin supports 27.

It should be apparent to those skilled in the art that the present invention may be embodied in many other specific forms without departing from the spirit or scope of the invention. Particularly, it should be understood that the invention may be embodied in the following forms.

The snap rings 33 fitted about the coupling portions 31*b* of the stud bolts 31 may be replaced by nuts, and the proximal portions 28*a* of the bracket 28 may be fixed to the steps 31*c* of the stud bolts 31. Alternatively, the support surface of each seat 31*c* may be formed conical. The E-shaped snap rings 33 may be replaced with C-shaped snap rings.

Therefore, the present examples and embodiments are to be considered as illustrative and not restrictive and the invention is not to be limited to the details given herein, but may be modified within the scope and equivalence of the appended claims.

What is claimed is:

1. An electric guitar, comprising:

a body;

a neck coupled to the body;

a plurality of strings extending from the neck to the body, each string having a first contact point defined on the neck;

a base plate having a pair of bores, each bore being formed in a respective side section of the base plate; and a hinge mechanism, each string having a second contact point defined on the hinge mechanism, the hinge mechanism supporting the base plate such that the base plate is pivotable relative to the body of the guitar, the hinge mechanism comprising:

a pair of brackets respectively situated near the side sections of the base plate in an area of the bores;

a respective support pin coupling each of the brackets to the body of the guitar, each support pin having a center axes;

a respective bearing device having an axial midpoint and being arranged inside a respective one of the bores, the support pins being located closer to the neck of the guitar than the respective bearing devices; and a respective bracket pin coupled to each of the brackets and extending through the respective bearing device to support the bearing device inside the respective bore of the base plate;

wherein the axial midpoint of each bearing device and the center axis of the respective support pin are located on a line that is substantially parallel to the strings of the electric guitar, and wherein each support pin has a seat to support a respective one of the brackets.

2. The electric guitar according to claim 1, wherein each seat is convex.

3. The electric guitar according to claim 1, wherein each support pin has an elastic ring to elastically support a respective one of the brackets.

4. The electric guitar according to claim 3, further comprising a respective fastener securing each elastic ring to the respective support pin.

5. The electric guitar according to claim 1, wherein each support pin has a lower part and a threaded portion on the lower part, and the body of the electric guitar has a respective threaded hole assigned to a respective one of the support pins, and wherein the threaded portion of each support pin is threaded with the respective threaded hole.

6. An electric guitar, comprising:

a body;

a neck coupled to the body;

a plurality of strings extending from the neck to the body, each string having a first contact point defined on the neck;

a base plate having a pair of bores, each bore being formed in a respective side section of the base plate; and a hinge mechanism, each string having a second contact point defined on the hinge mechanism, the hinge mechanism supporting the base plate such that the base plate is pivotable relative to the body of the guitar, the hinge mechanism comprising:

a pair of brackets respectively situated near the side sections of the base plate in an area of the bores;

a respective support pin coupling each of the brackets to the body of the guitar, each support pin having a center axes;

a respective bearing device having an axial midpoint and being arranged inside a respective one of the bores, the support pins being located closer to the neck of the guitar than the respective bearing devices; and a respective bracket pin coupled to each of the brackets and extending through the respective bearing device to support the bearing device inside the respective bore of the base plate;

a fine-tuning device located on the base plate, the fine-tuning device being operable to fine-tune the strings without substantially changing positions of the first and second contact points; and a tremolo bar attached to one of the brackets of the hinge mechanism;

wherein the axial midpoint of each bearing device and the center axis of the respective support pin are located on a line that is substantially parallel to the strings of the electric guitar, and wherein each support pin has a seat to support a respective one of the brackets of the hinge mechanism.

7. An electric guitar, comprising:

a body;

a neck coupled to the body;

a plurality of strings extending from the neck to the body, each string having a first contact point defined on the neck;

a base plate having a pair of bores, each bore being formed in a respective side section of the base plate; and a hinge mechanism, each string having a second contact point defined on the hinge mechanism, the hinge mechanism supporting the base plate such that the base plate is pivotable relative to the body of the guitar, the hinge mechanism comprising:

a pair of brackets respectively situated near the side sections of the base plate in an area of the bores;

a respective support pin coupling each of the brackets to the body of the guitar, each support pin having a center axes;

a respective bearing device having an axial midpoint and being arranged inside a respective one of the bores, the support pins being located closer to the neck of the guitar than the respective bearing devices; and a respective bracket pin coupled to each of the brackets and extending through the respective bearing device to support the bearing device inside the respective bore of the base plate;

a fine-tuning device located on the base plate, the fine-tuning device being operable to fine-tune the strings without substantially changing positions of the first and second contact points; and a tremolo bar attached to one of the brackets of the hinge mechanism;

wherein the axial midpoint of each bearing device and the center axis of the respective support pin are located on a line that is substantially parallel to the strings of the electric guitar, and wherein each bracket of the hinge mechanism has an elongated hole, through which the respectively assigned support pin of the hinge mechanism extends, a cross section of each elongated hole being elongated in a direction perpendicular to the strings of the guitar, and wherein each support pin has an elastic ring to elastically support a respective one of the brackets.

8. An electric guitar, comprising:

a body;

a neck coupled to the body;

a plurality of strings extending from the neck to the body, each string having a first contact point defined on the neck;

a base plate having a pair of bores, each bore being formed in a respective side section of the base plate; and a hinge mechanism, each string having a second contact point defined on the hinge mechanism, the hinge mechanism supporting the base plate such that the base plate is pivotable relative to the body of the guitar, the hinge mechanism comprising:

a pair of brackets respectively situated near the side sections of the base plate in an area of the bores;

a respective support pin coupling each of the brackets to the body of the guitar, each support pin having a center axes;

a respective bearing device having an axial midpoint and being arranged inside a respective one of the bores, the support pins being located closer to the neck of the guitar than the respective bearing devices; and a respective bracket pin coupled to each of the brackets and extending through the respective bearing device to support the bearing device inside the respective bore of the base plate;

wherein the axial midpoint of each bearing device and the center axis of the respective support pin are located on a line that is substantially parallel to the strings of the electric guitar.

9. The electric guitar according to claim 8, further comprising a fine-tuning device located on the base plate, wherein the fine-tuning device is operable to fine-tune the strings without substantially changing positions of the first and second contact points.

10. The electric guitar according to claim 8, wherein a tremolo bar is attached to one of the brackets.

11. The electric guitar according to claim 8, wherein each bracket has an elongated hole, through which the respective support pin extends, and wherein a cross section of each elongated hole is elongated in a direction perpendicular to the strings of the electric guitar.

12. An electric guitar, comprising:

a body;

a neck coupled to the body;

a plurality of strings extending from the neck to the body, each string having a first contact point defined on the neck;

a base plate having a pair of bores, each bore being formed in a respective side section of the base plate; and a hinge mechanism, each string having a second contact point defined on the hinge mechanism, the hinge mechanism supporting the base plate such that the base plate is pivotable relative to the body of the guitar, the hinge mechanism comprising:

a pair of brackets respectively situated near the side sections of the base plate in an area of the bores;

a respective support pin coupling each of the brackets to the body of the guitar, each support pin having a center axes;

a respective bearing device having an axial midpoint and a pair of bearings, the respective bearing device being arranged inside a respective one of the bores, the support pins being located closer to the neck of the guitar than the respective bearing devices;

a respective spacer located inside each of the bearing devices between the pair of bearings; and a respective bracket pin coupled to each of the brackets and extending through the respective bearing device to support the bearing device inside the respective bore of the base plate;

wherein the axial midpoint of each bearing device and the center axis of the respective support pin are located on a line that is substantially parallel to the strings of the electric guitar.

13. The electric guitar according to claim 12, further comprising a fine-tuning device located on the base plate, wherein the fine-tuning device is operable to fine-tune the strings of the electric guitar without substantially changing positions of the first and second contact points.

14. The electric guitar according to claim 12, wherein a tremolo bar is attached to one of the brackets.

15. The electric guitar according to claim 12, wherein each bracket has an elongated hole, through which the respective support pin extends, and wherein a cross section of each elongated hole is elongated in a direction perpendicular to the strings.

16. The electric guitar according to claim 12, wherein each support pin has a seat to support a respective one of the brackets.

17. The electric guitar according to claim 16, wherein each support pin has an elastic ring to elastically support the corresponding bracket.

18. The electric guitar according to claim 17, further comprising a respective fastener securing each elastic ring to the respective support pin.

19. An electric guitar, comprising:

a body;

a neck coupled to the body;

a plurality of strings extending from the neck to the body, each string having a first contact point defined on the neck;

a base plate having a pair of bores, each bore being formed in a respective side section of the base plate; and a hinge mechanism, each string having a second contact point defined on the hinge mechanism, the hinge mechanism supporting the base plate such that the base plate is pivotable relative to the body of the guitar, the hinge mechanism comprising:

a pair of brackets respectively situated near the side sections of the base plate in an area of the bores;

a respective support pin coupling each of the brackets to the body of the guitar, each support pin having a center axes;

a respective bearing device having an axial midpoint and being arranged inside a respective one of the bores, the support pins being located closer to the neck of the guitar than the respective bearing devices; and a respective bracket pin coupled to each of the brackets and extending through the respective bearing device to support the bearing device inside the respective bore of the base plate;

a fine-tuning device located on the base plate, the fine-tuning device being operable to fine-tune the strings without substantially changing positions of the first and second contact points; and a tremolo bar attached to one of the brackets of the hinge mechanism;

wherein the axial midpoint of each bearing device and the center axis of the respective support pin are located on a line that is substantially parallel to the strings of the electric guitar.

20. The tremolo unit according to claim 19, wherein each bracket of the hinge mechanism has an elongated hole, through which the respective support pin extends, and wherein a cross section of each elongated hole is elongated in a direction perpendicular to the strings of the guitar.

* * * * *